US006870174B2

(12) United States Patent
Yamaguchi et al.

(10) Patent No.: US 6,870,174 B2
(45) Date of Patent: Mar. 22, 2005

(54) ELECTRON BEAM TUBE AND WINDOW FOR ELECTRON BEAM EXTRACTION

(75) Inventors: Masanori Yamaguchi, Hyogo (JP); Katsuya Okumura, Tokyo (JP)

(73) Assignees: Ushio Denki Kabushiki Kaisha, Tokyo (JP); Octec, Inc., Tokyo (JP)

( * ) Notice: Subject to any disclaimer, the term of this patent is extended or adjusted under 35 U.S.C. 154(b) by 0 days.

(21) Appl. No.: 10/864,445

(22) Filed: Jun. 10, 2004

(65) Prior Publication Data

US 2004/0251431 A1 Dec. 16, 2004

(30) Foreign Application Priority Data

Jun. 13, 2003 (JP) ..... 2003-168629

(51) Int. Cl.[7] ..... H01J 1/52; H01J 33/00

(52) U.S. Cl. ..... 250/492.3; 250/505.1; 313/420; 378/161

(58) Field of Search ..... 250/492.3, 505.1; 313/420; 378/161; 216/79, 100, 108, 109; 438/704, 924

(56) References Cited

U.S. PATENT DOCUMENTS 3,749,967 A * 7/1973 Douglas-Hamilton et al. ... 315/85
5,612,588 A * 3/1997 Wakalopulos ..... 313/420
5,621,270 A * 4/1997 Allen ..... 313/420
5,698,870 A * 12/1997 Nakano et al. ..... 257/194
5,869,364 A * 2/1999 Nakano et al. ..... 438/167
5,940,694 A * 8/1999 Bozada et al. ..... 438/172
6,002,202 A * 12/1999 Meyer et al. ..... 313/420
6,124,063 A * 9/2000 Dauksher et al. ..... 430/5
6,140,755 A 10/2000 Neukermans et al.
6,224,445 B1 5/2001 Neukermans et al.
6,657,212 B2 12/2003 Komori et al.
6,693,290 B2 2/2004 Yamaguchi
2002/0074519 A1 6/2002 Yamaguchi
2003/0042832 A1 3/2003 Yamaguchi

FOREIGN PATENT DOCUMENTS

JP 06-317700 A 11/1994
JP 2001-59900 A 3/2001

* cited by examiner

*Primary Examiner*—John R. Lee
*Assistant Examiner*—Bernard E. Souw
(74) *Attorney, Agent, or Firm*—Rader, Fishman & Grauer PLLC

(57) ABSTRACT

An object of the present invention is to provide to an electron beam tube and electron beam extraction window capable of generating high output electron beam by effectively releasing heat generated when an electron beam passes through a window whereby temperature rise of the window is controlled and breakage of the window is prevented. The electron beam tube comprises first projections continuously provided on a first surface of the window, and second projections which are continuously formed on a second surface of the window and are located in positions corresponding to areas between the first projections wherein a projection height of the second projection, a projection width of the second projection and a distance between the adjacent second projections are smaller than those of the first projections, respectively.

16 Claims, 16 Drawing Sheets

Emitting Surface Side 57
55
58
Starting Material (SOI Wafer)
Incidence Surface Side 59
57
55
58
Application of Resist 59
57
55
58
Exposure and Development 59
55
58
Dry Etching of Si 53
54
55
58
Removal of Resist 53
54
55
58
60
Application of Resist 53
54
55
58
60
Exposure and Development 53
54
55
52
60
Dry Etching of Si 53
54
55
52
Removal of Resist Starting Material (Both Side Ground Wafer)

Formation of $SiO_2$ Film by Thermal Oxidation

Formation of Poly-Si Film by CVD

Application of Resist

Exposure and Development

Dry Etching of Si

Removal of Resist

Removal of Resist

Exposure and Development

Dry Etching of Si

Removal of Resist

Application of Resist

Exposure and Development

Dry Etching of Si

Removal of Resist

Dry Etching of Si

Wet Etching of Cu

ELECTRON BEAM TUBE AND WINDOW FOR ELECTRON BEAM EXTRACTION

TECHNICAL FIELD OF THE INVENTION

The present invention relates to an electron beam tube which is used for curing a resist which has been applied to a semiconductor wafer by irradiation of an electron beam or for drying ink which has been applied to various printed matter, and a window for electron beam extraction which takes out an electron beam from the electron beam tube etc.

DESCRIPTION OF RELATED ART

Conventionally, a thermionic-tube type electron beam tube as disclosed in Japanese Laid Open Patent No. 2001-59900 is known.

FIG. 15 is an overall view of an electron beam tube disclosed in the above-mentioned Japanese Laid Open Patent. As shown in the figure, in the electron beam tube, an electron beam generator 102 is placed inside a vacuum container 101 having an opening and a lid member 103 made of silicon is disposed so as to cover the opening on top of the vacuum container 101. A through-hole 104 is provided in the central part of the lid member 103, and a window 105 is provided so that the window 105 covers the through-hole 104. An electron beam generated by the electron beam generator 102 passes through the window 105, and is radiated outside the electron beam tube.

The window 105 comprises, for example, rectangular window portions 1051 which are formed by using a silicon wafer as starting material with overall thickness of 500 micrometers, carrying out an etching process, thereby forming it as a thin film, wherein the window transmits an electron beam, and projections 1052 which mechanically reinforce each window portion 1051 between respective window portions 1051. Each window portion 1051 has the thickness of, for example, 3 micrometers. Besides the above-mentioned thermionic-tube type electron beam tube, an electron beam irradiation device disclosed in Japanese Laid Open Patent No. 6-317700 is known.

FIG. 16 is a schematic view of the electron beam irradiation device disclosed in the above-mentioned Japanese Laid Open Patent. As shown in this figure, this electron beam irradiation device is equipped with an electron beam generating portion 201, an irradiation chamber 202, and an irradiation window portion 203, and the electron beam generating portion 201 comprises a terminal 204 for generating an electron beam and an acceleration vacuum chamber 205 which accelerates an electron beam generated in a vacuum space of the terminal 204. The inside of the electron beam generating portion 201 is maintained at a predetermined vacuum by a diffusion pump etc. which is not shown, and the irradiation window portion 203 comprises a window foil 206 made of metallic foil, and a window frame structure 207 which supports the window foil 206 so that an electron beam is taken out in the irradiation chamber 202 via the window foil 206. This window foil 206 does not have any pinhole, and has the mechanical strength so that the vacuum atmosphere can be sufficiently maintained in the electron beam generating portion 201, and the window foil 206 is thin, made of metal, and has small specific gravity by which an electron beam tends to pass through the window foil 206.

FIG. 17 is a cross sectional view of part of the window 105 used for an electron beam tube as shown in FIG. 15 wherein the window 105 is manufactured by a manufacturing method according to the conventional technology.

In the manufacture process of the window 105, first, a starting material in which an etching stop layer 1053 made of $SiO_2$ is formed on a uniform lower layer made of Si which is not shown, and further an upper layer 1054 made of Si is formed on the etching stop layer 1053, is prepared.

Next, a resist layer used as a mask is formed on the predetermined region of the lower layer, and in this condition, dry etching of the lower layer is carried out. Consequently, as shown in FIG. 17, the lower layer where the resist layer is not formed is etched until the etching stop layer 1053 is exposed, and on the other hand, portions of the lower layer where the resist layer is formed remain so as to form projections 1052 which reinforce the window portion 1051.

Here, the etching stop layer 1053 only functions so as to stop the process of etching, and when an electron beam passes through the layer, the stress is concentrated on the layer since the crystal structure of the etching stop layer 1053 has many defects, and, therefore, the mechanical strength cannot be maintained.

Therefore, the upper layer 1054 is formed whereby the substantial window function is achieved.

In addition, as described above, since the window portion 1051 is very thin, for example, 3 micrometers in thickness as a whole, a protective film 1055 made of SiN is formed on the upper layer 1054 so as to strengthen reinforcement of the entire window 105.

A manufacturing method of such a window is disclosed in International Patent Publication No. 2000-512794 is known.

SUMMARY OF THE INVENTION

In recent years, an electron beam tube or an electron beam irradiation device etc. is required to output a further high-output electron beam.

However, for example, in the conventional window structure as shown in FIG. 17, if the high-output electron beam is emitted, as the amount of electron beam which passes through the window of the electron beam tube or the electron beam irradiation device increases, the temperature of a window portion 1051 rises, and the window portion 1051 causes heat deterioration thereby destroying the window portions.

In view of the above-mentioned problem, it is an object of the present invention to prevent breakage of a window due to heat by efficiently releasing, outside the window, the heat generated in the window when an electron beam passes through the window so that the temperature rise of the window is controlled.

It is another object of the present invention to provide an electron beam tube capable of generating high output and an electron beam extraction window for taking out an electron beam.

The objects of the present invention is accomplished by an electron beam tube in which an electron beam generator is disposed in a vacuum container having a window for emitting an electron beam, the electron beam tube. Specifically, the electron beam tube comprises first projections continuously provided on a first surface of the window, and second projections which are continuously formed on a second surface of the window and are located in positions corresponding to areas between the first projections wherein a projection height of the second projection, a projection width of the second projection and a distance between the adjacent second projections are smaller than those of the first projections, respectively.

Also the objects of the present invention are accomplished by an electron beam tube in which an electron beam generator is disposed in a vacuum container having a window for emitting an electron beam. Specifically, the electron beam tube comprises first projections continuously provided on a first surface of the window, and second projections which are continuously formed between the first projections on the first surface of the window wherein a projection height of the second projections, a projection width of the second projections and a distance between the adjacent second projections are smaller than those of the first projections, respectively.

In the electron beam tube, the second projections may be made of crystalline or amorphous Si.

The window may have at least a layer made of Si or $Al_2O_3$.

Further, a protective film made of SiC or SiN may be formed on both sides of the window.

Further, the objects of the present invention are accomplished by an electron beam extraction window in which an electron beam generated by an electron beam generator provided in a vacuum container is extracted outside the vacuum container, the electron beam extraction window. Specifically, the electron beam extraction window comprises first projections continuously provided on a first surface of the electron beam extraction window, and second projections which are continuously formed on a second surface of the electron beam extraction window and are located in positions corresponding to areas between the first projections wherein a projection height of the second projection, a projection width of the second projection and a distance between the adjacent second projections are smaller than those of the first projections, respectively.

Furthermore, the objects of the present invention are accomplished by an electron beam extraction window in which an electron beam generated by an electron beam generator provided in a vacuum container,is extracted outside the vacuum container, the electron beam extraction window. Specifically, the electron beam extraction window comprises first projections continuously provided on a first surface of the electron beam extraction window, and second projections which are continuously formed between the first projections on the first surface of the electron beam extraction window wherein a projection height of the second projections, a projection width of the second projections and a distance between the adjacent second projections are smaller than those of the first projections respectively.

The present invention will become more apparent from the following detailed description of the embodiments and examples of the present invention.

DETAILED DESCRIPTION OF THE INVENTION

A first embodiment of the present invention will be described referring to FIGS. 1 to 12.

Figure 1:
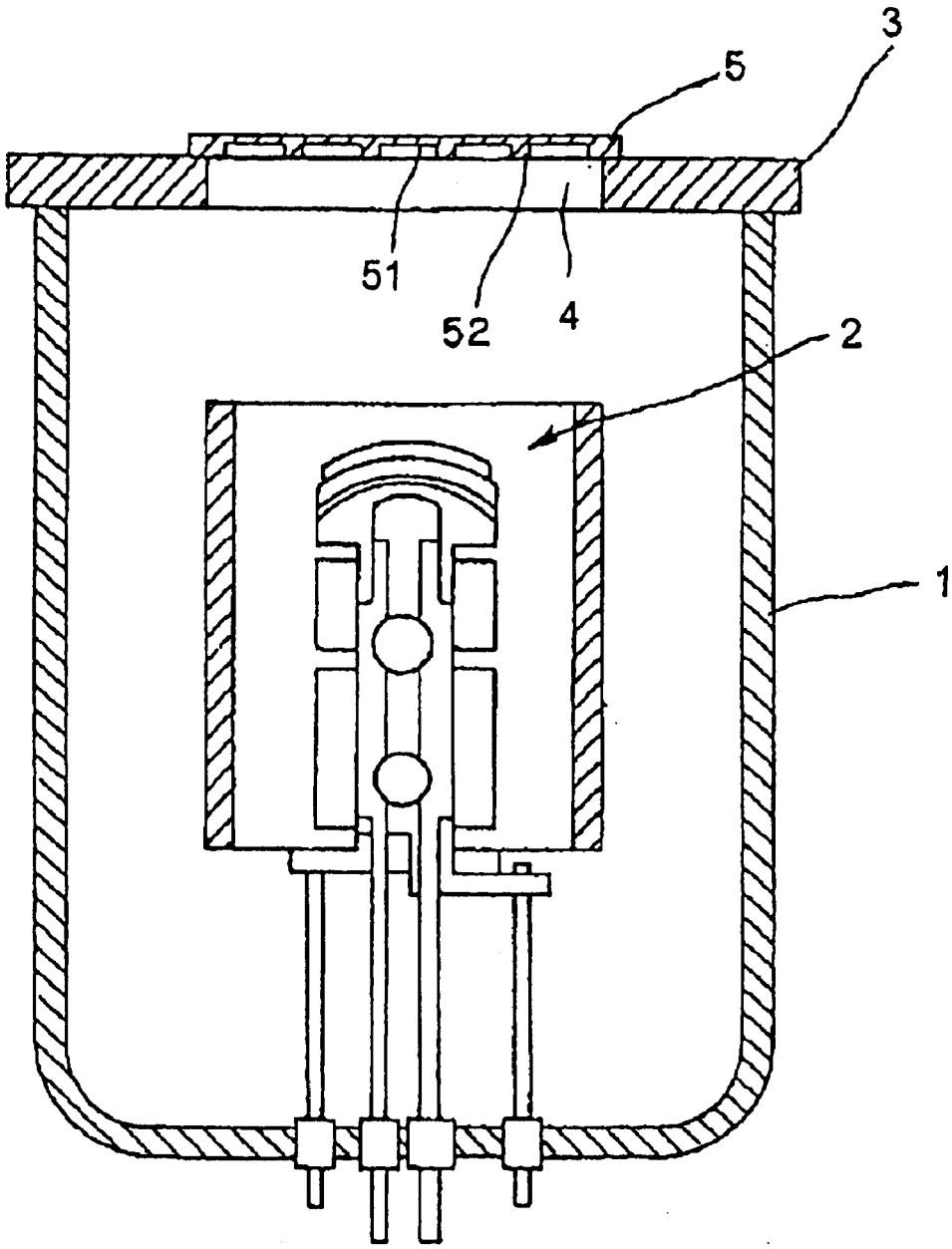
FIG. 1 is a cross sectional view of the overall structure of an electron beam tube according to a first embodiment of the present invention.

FIG. 1 is a cross sectional view of the overall structure of an electron beam tube according to the first embodiment of the present invention.

As shown in the figure, the electron beam tube comprises a vacuum container 1, an electron beam generator 2 which is provided in the vacuum container 1, a lid member 3 made of Si, which is provided so that an opening of the vacuum container 1 is covered in an upper portion of the container 1, a through-hole 4 which is provided in the central portion of the lid member 3, a window 5 which is provided on the surface of the lid member 3 in order to cover the through-hole 4, window portions 51 through which an electron beam passes, and first projections 52 which are made of Si and formed between respective window portions 51. An electron beam generated by the electron beam generator 2 passes through the window portions 51 of the window 5, and is emitted out of the electron beam tube.

Figure 2A:
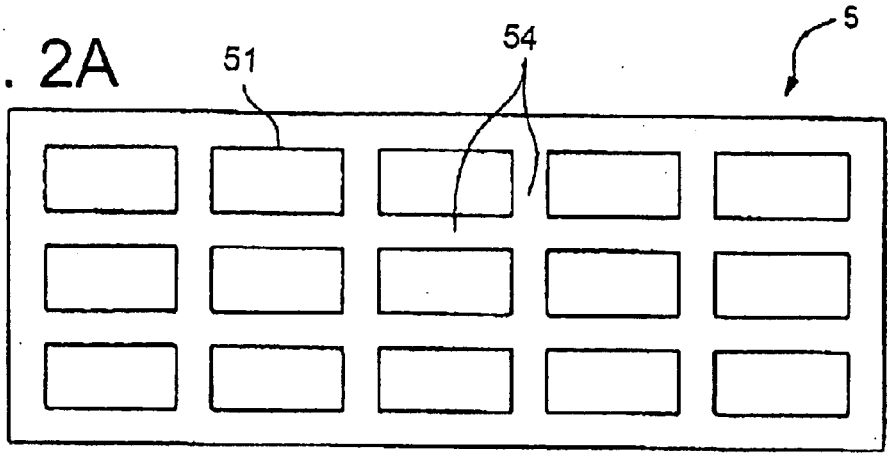
FIG. 2A is an enlarged plan view of the window 5 on the electron beam emitting surface side in FIG. 1.
Figure 2B:
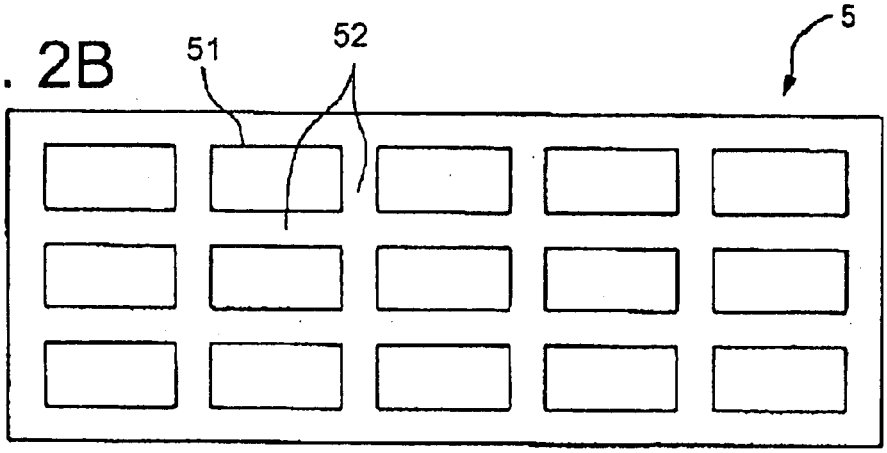
FIG. 2B is an enlarged plan view of the window 5 on the electron beam incidence surface side.
Figure 2C:
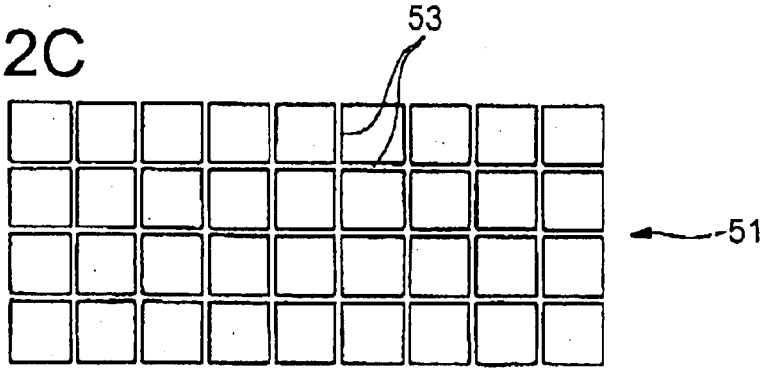
FIG. 2C is an enlarged plan view of a window portion 51 on the electron beam emitting surface side.

FIG. 2A is an enlarged plan view of the window 5 on the electron beam emitting surface side in FIG. 1. FIG. 2B is an enlarged plan view of the window 5 on the electron beam incidence surface side. FIG. 2C is an enlarged plan view of a window portion 51 on the electron beam emitting surface side.

In these figures, second projections 53 is made of Si and formed on the electron beam emitting surface side of the window portion 51, third projections 54 being made of Si and formed on the electron beam emitting surface side of the window 5. An etching stop layer 55 is made of $SiO_2$ and used for an etching process described above, a protective film 56 being made of SiC or SiN and formed on both side of the window 5. (Also refer to FIG. 6)

As shown in FIG. 2A, the third projections 54 are formed in rows and columns, that is, in a grid like structure, in order to reinforce the window 5 on the electron beam emitting surface side of the window 5. In addition, as shown in FIG. 2B, on the election beam incidence surface side of the window 5, the first projections 52 are formed in rows and columns, that is, in a grid like structure, in a position approximately corresponding to the third projections 54 in order to reinforce the window.

In addition, as shown in FIG. 2C, the second projections 53 are formed in rows and columns, that is, in a grid like structure, on the electron beam emitting surface side of the window portion 51, in order to release heat which is generated when an electron beam passes through the window portion 51, outside the window portion 51.

In FIGS. 2A, 2B and 2C, although the first projections 52, the second projections 53, and the third projections 54 are grid-shaped respectively, they are not limited to such shape.

Figure 3A:
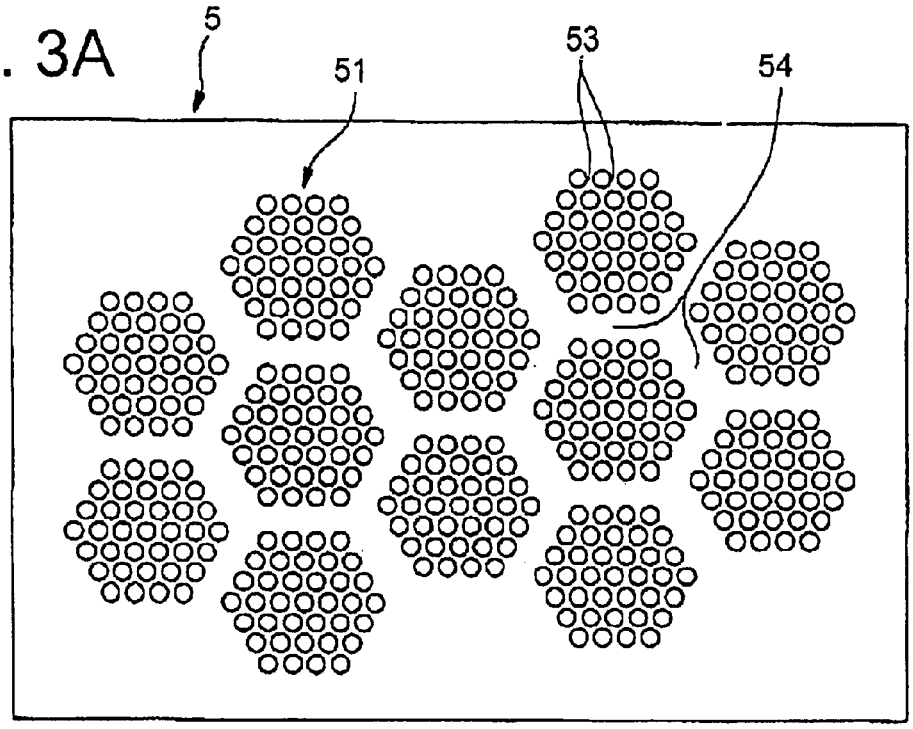
FIG. 3A is an enlarged plan view of another example of the window 5 on the electron beam emitting surface side in FIG. 1.
Figure 3B:
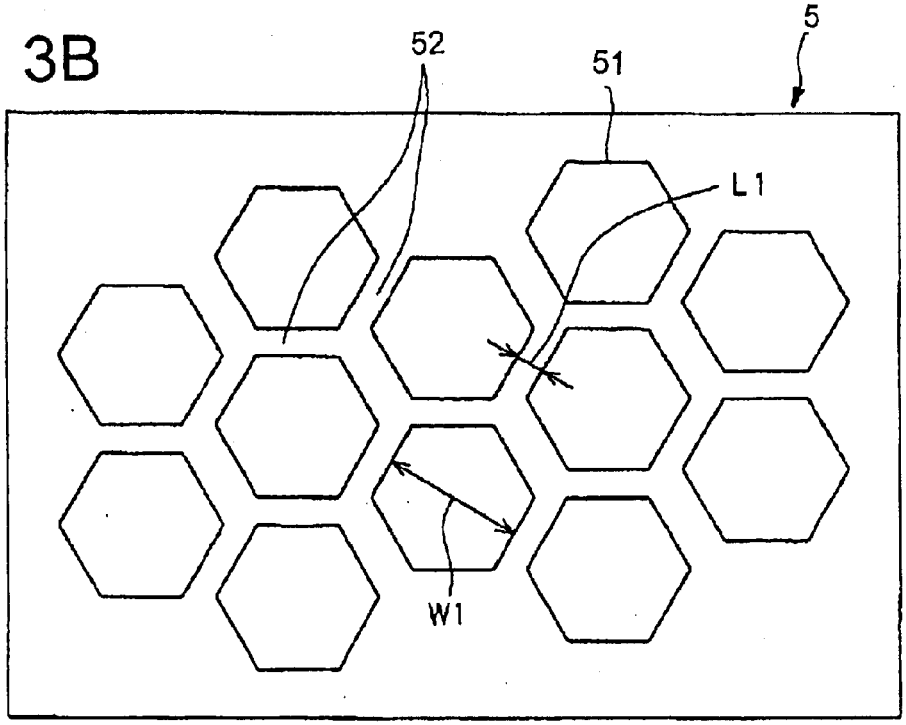
FIG. 3B is an enlarged plan view of another example of the window 5 on the electron beam incidence surface side in FIG. 1.

FIG. 3A is an enlarged plan view of the electron beam emitting surface of the window 5 shown in FIG. 1, which has window structure which is different from that shown in FIG. 2A. FIG. 3B is an enlarged plan view of the electron beam incidence surface of the window 5 shown in FIG. 1, which has the window structure which is different from that shown in FIG. 2B.

As shown in FIG. 3A, the third projections 54 whose shape is hexagon are continuously formed on the electron beam emitting surface side of the window in order to reinforce the window 5. The second projections 53 whose shape is approximately hexagon are continuously formed on the window portion 51 in order to release, outside the window portion 51, heat generated when an electron beam passes through the window portion 51.

In addition, as shown in FIG. 3B, the first projections 52 whose shape is hexagon are continuously formed in a position approximately corresponding to the third projections 54 on the electron beam incidence surface side of the window 5 in order to reinforce the window 5.

Figure 4:
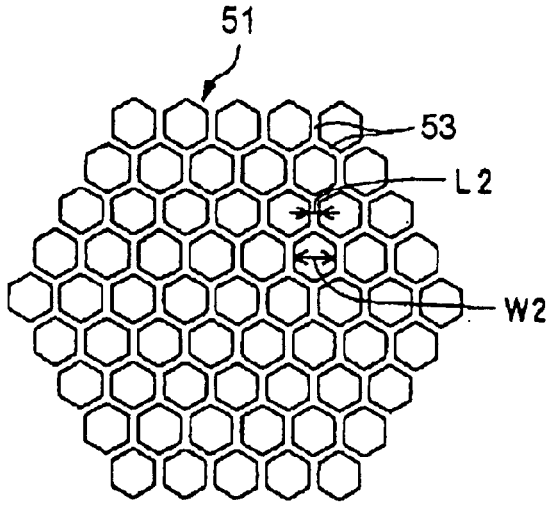
FIG. 4 is another example of the window portions 51 of FIG. 3A, wherein the second projections 53 are continuously formed in shape of hexagon.

FIG. 4 is another example of the window portions 51 of FIG. 3A, wherein the second projections 53 are continuously formed in shape of hexagon.

Figure 5:
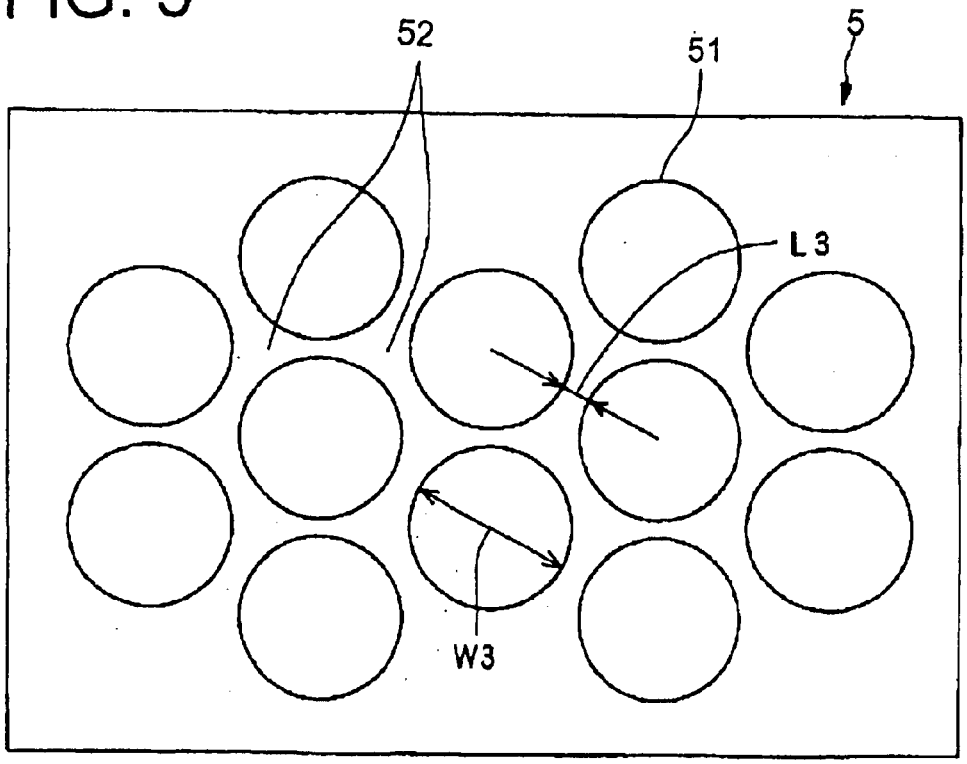
FIG. 5 is an enlarged plan view of the window 5 shown in FIG. 1 on the electron beam incidence surface, wherein the shape of the window 5 is different from that shown in FIG. 2B and FIG. 3B.

FIG. 5 is an enlarged plan view of the window 5 shown in FIG. 1 on the electron beam incidence surface side, wherein the shape of the window 5 is different from that shown in FIG. 2B and FIG. 3B.

When, as shown in FIGS. 3A, 3B and 4, the shape of each projection of the window portion 51 is hexagon, the strength of the window 5 can be increased since stress is dispersed, compared with rectangle or square window portions.

Even in the case that the shape of each projection of the window portion 51 is rectangular or square, the stress can be dispersed by making surrounding corners into an R-shape, and, in addition, the stress can be further dispersed by forming the window portion 51 in a round shape as shown in FIG. 5.

In FIG. 3A, the projection height of the second projections 53 is 5 $\mu$m (micrometers), the width of the second projections 53 which is defined by the minimum width of the second projections 53 is 5 $\mu$m and the internal diameter of each round portion surrounded by the second projection 53 on the figure, that is, the distance between the second projections 53 is 10 $\mu$m.

In FIG. 3B, the projection height of the first projections 52 is 600 $\mu$m, and the width L1 of a portion between the adjacent first projections 52 is 200 $\mu$m, wherein the width L1 is the minimum width of the first projections 52. The distance W1 between the first projections 52 is 600 $\mu$m, and this distance W1 is the distance between facing diagonal planes of the hexagon shape portion surrounded by the first projections 52 on the figure.

In FIG. 4, the projection height of the second projections 53 is 10 $\mu$m, and the width L2 of the second projections 53 is 5 $\mu$m wherein the width L2 is the minimum width of the second projections 53. The distance W2 between the second projections 53 is 25 $\mu$m, and this distance W2 is the distance between facing diagonal planes of the hexagon shape portion surrounded by the second projections 53 on the figure.

In FIG. 5, the projection height of the first projection 52 is 300 $\mu$m, and the width L3 of the first projections 52 is 300 $\mu$m wherein this width L3 is the minimum width of the first projections 52. The distance W3 between the first projections 52 is 1000 $\mu$m, wherein this distance W3 is the internal diameter of the round shape portion surrounded by the first projections 52 in the figure.

Figure 6:
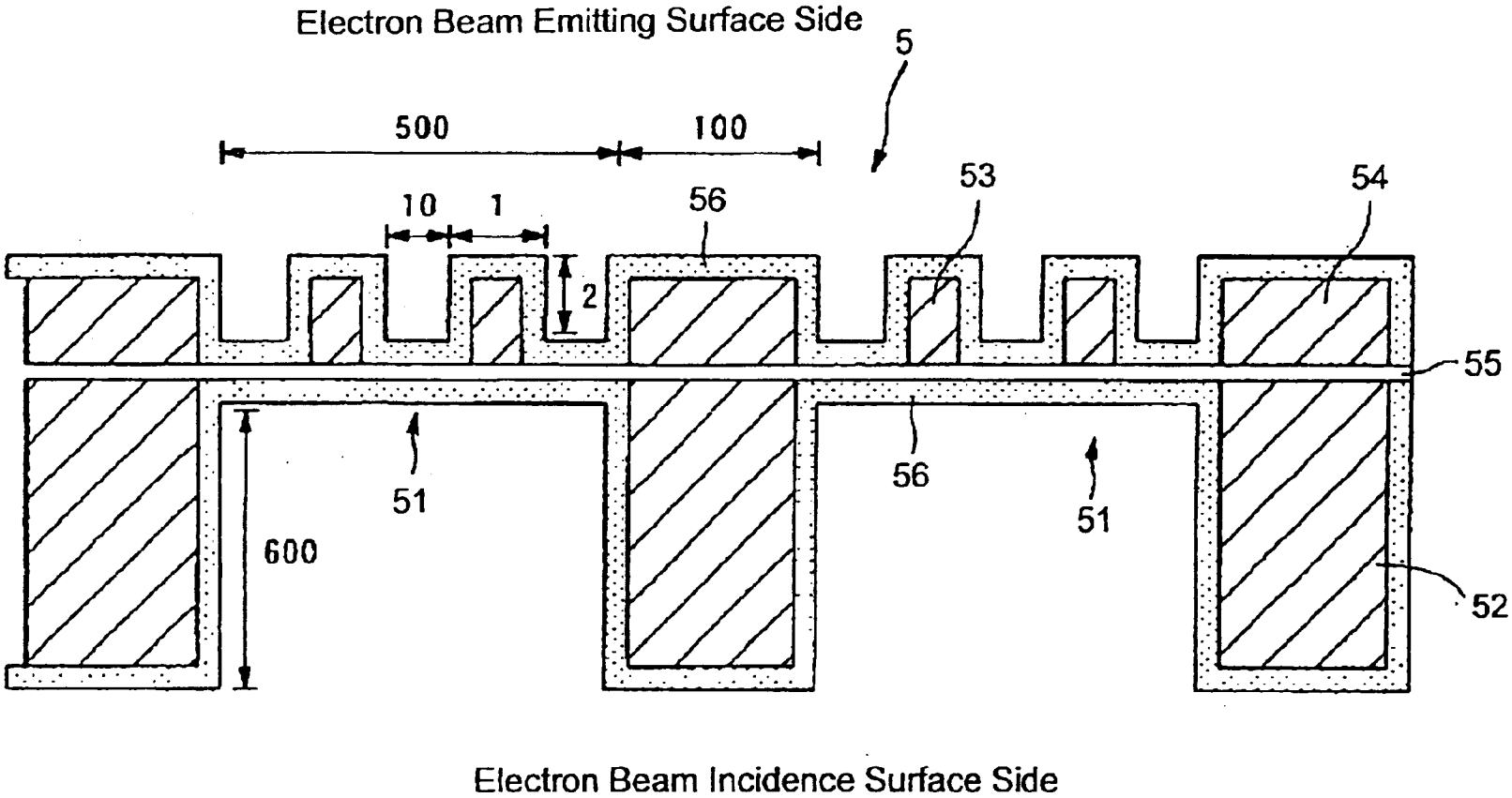
FIG. 6 is an enlarged sectional view of the window 5 shown in FIG. 1.

FIG. 6 is an enlarged cross sectional view of the window 5 which has the shape of the window portion 51 shown in FIG. 2.

As shown in this cross-section structure, the first projections 52 for mechanically reinforcing the window 5 is formed on the electron beam incidence surface side of the etching stop layer 55, and the third projection 54 for mechanically reinforcing the window 5 and the second projections 53 for releasing heat generated when an electron beam passes through the window portion 51 to the third projections 54 are formed on the electron beam emitting surface side.

On both sides of the window 5, a protective film 56 for increasing the mechanical strength of the window 5 is formed. By forming the protective file 56 on the both sides of the window 5, the stress which is generated in the window 5 when the protective film 56 is formed can be cancelled, so that it is possible to reduce warpage in comparison to a case where the film is formed on only one of the sides.

FIG. 6 shows numeric values as one example of the dimension of each part of the window 5, wherein the width of the first projections 52 and the third projections 54 is 100 $\mu$m respectively, and the distance between the first projections 52 and between the third projections 54 is 500 $\mu$m, respectively. The projection height of the first projections 52, the projection height of the second projections 53 and the third projections 54, the width of the second projections 53 and the distance between the second projections 53 are 600 $\mu$m, 2 $\mu$m, 1 $\mu$m and 10 $\mu$m, respectively.

As is clear from the dimension, compared with the first projections 52, the projection height, projection width, and distance between adjacent projections of the second projections 53 is very small.

As shown in FIGS. 2C and 6, areas surrounded by the first projections 52 constitute the window portions 51 through which an electron beam passes, and very minute grid-shaped second projections 53 which are smaller than the first projections 52 are continuously formed on the window portions 51. Since the distance between the second projections 53 is larger than the width of the second projections 53, the spaced areas through which an electron beam fully passes are secured so that the electron beam can pass through these areas.

The heat generated when the electron beam passes through these spaced portions is transferred to the second projections 53 and further the heat transferred to the second projections 53 is transferred to the third projections 54 and the first projection 52, and finally transferred to the lid member 3 and then radiated as shown in FIG. 1.

That is, even if the high-output electron beam passes through the window portion 51 thereby generating more heat in the window portions 51 than that in the conventional ones, the heat is effectively released to the lid member 3 through the second projections 53, and the temperature rise of the window portions 51 can be controlled so as to prevent breakage of the window portions 51 due to the heat.

Next, an example of a manufacturing method of the window 5 shown in FIG. 6 is explained, referring to FIG. 7.

Figures 7A, 7B, 7C, 7D, 7E, 7F, 7G, 7H, 7I:
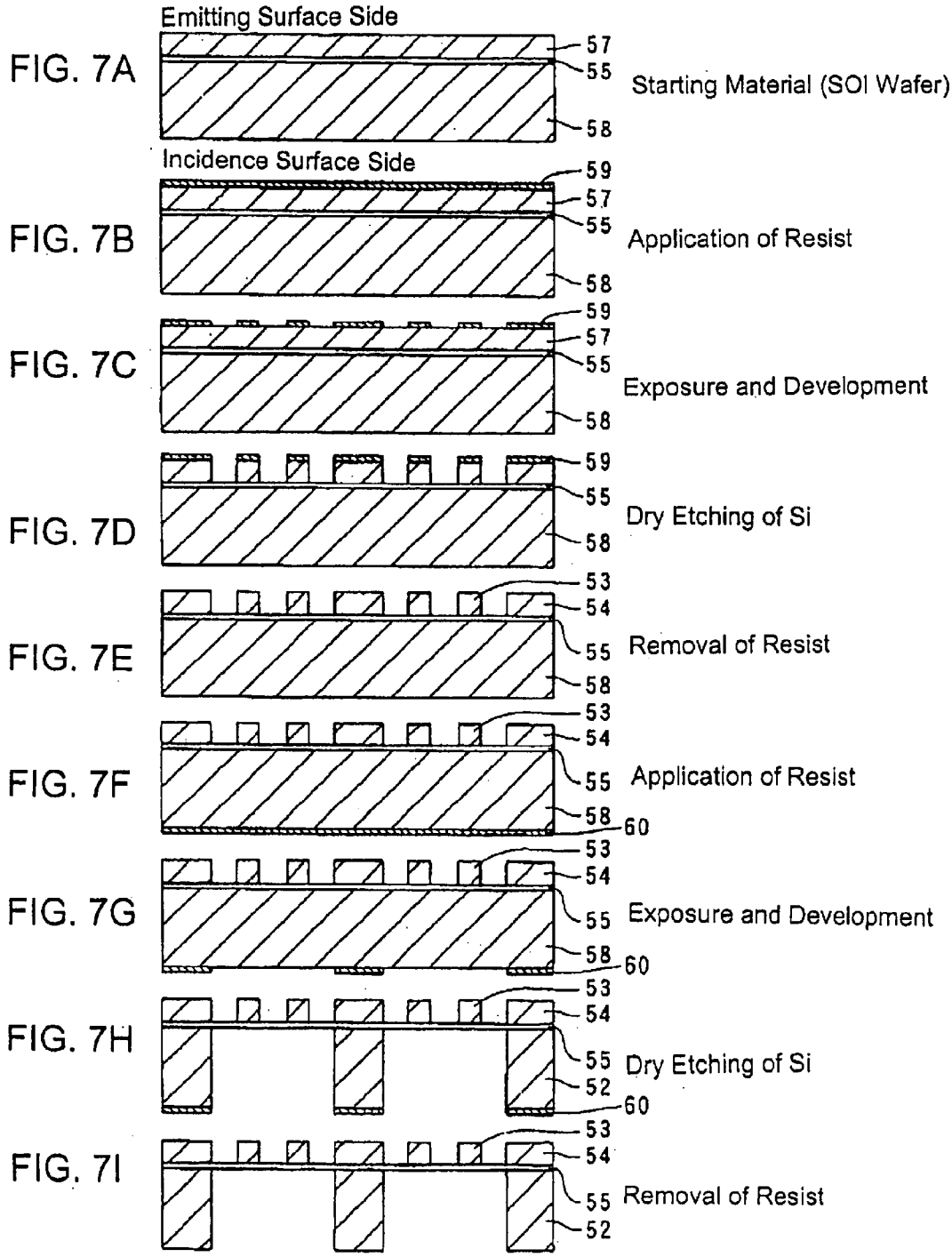
FIGS. 7A–7I are diagrams for showing steps of a manufacturing method of the window 5 shown in FIG. 6.

As shown in FIG. 7A, first, starting material in which a lower layer 58 made of Si is formed on a lower side of the etching stop layer 55 made of $SiO_2$ and an upper layer 57 which is made of Si and thinner than the lower layer 58 is formed on an upper side of the etching stop layer 55 is prepared.

Next, a resist 59 is applied to the surface of the upper layer 57 as shown in FIG. 7B, and then the material on which the resist is applied is exposed and developed so as to form a predetermined pattern as shown in FIG. 7C. Next, dry etching is performed as shown in FIG. 7D, and the resist 59 is removed as shown in FIG. 7E. Thereby, projections corresponding to the second projections 53 and the third projection 54 shown in FIG. 6 are formed on the upper portion of the etching stop layer 55.

Next, as shown in FIG. 7F, a resist 60 is applied to the surface of the lower layer 58, and then the material on which the resist is applied is exposed and developed so as to form a predetermined pattern as shown in FIG. 7G, and then dry etching is performed as shown in FIG. 7H, and next the resist 60 is removed as shown in FIG. 7I whereby projections corresponding to the first projections 52 shown in FIG. 6 are formed on the lower portion of the etching stop layer 55. At end of the process, although not illustrated, the protective film 56 made of SiC or SiN is formed on the both sides of the window 5 thereby obtaining the window 5 as shown in FIG. 6.

In this embodiment, although $SiO_2$ is used as the etching stop layer, $Al_2O_3$ may be used in place of $SiO_2$.

Figure 8:
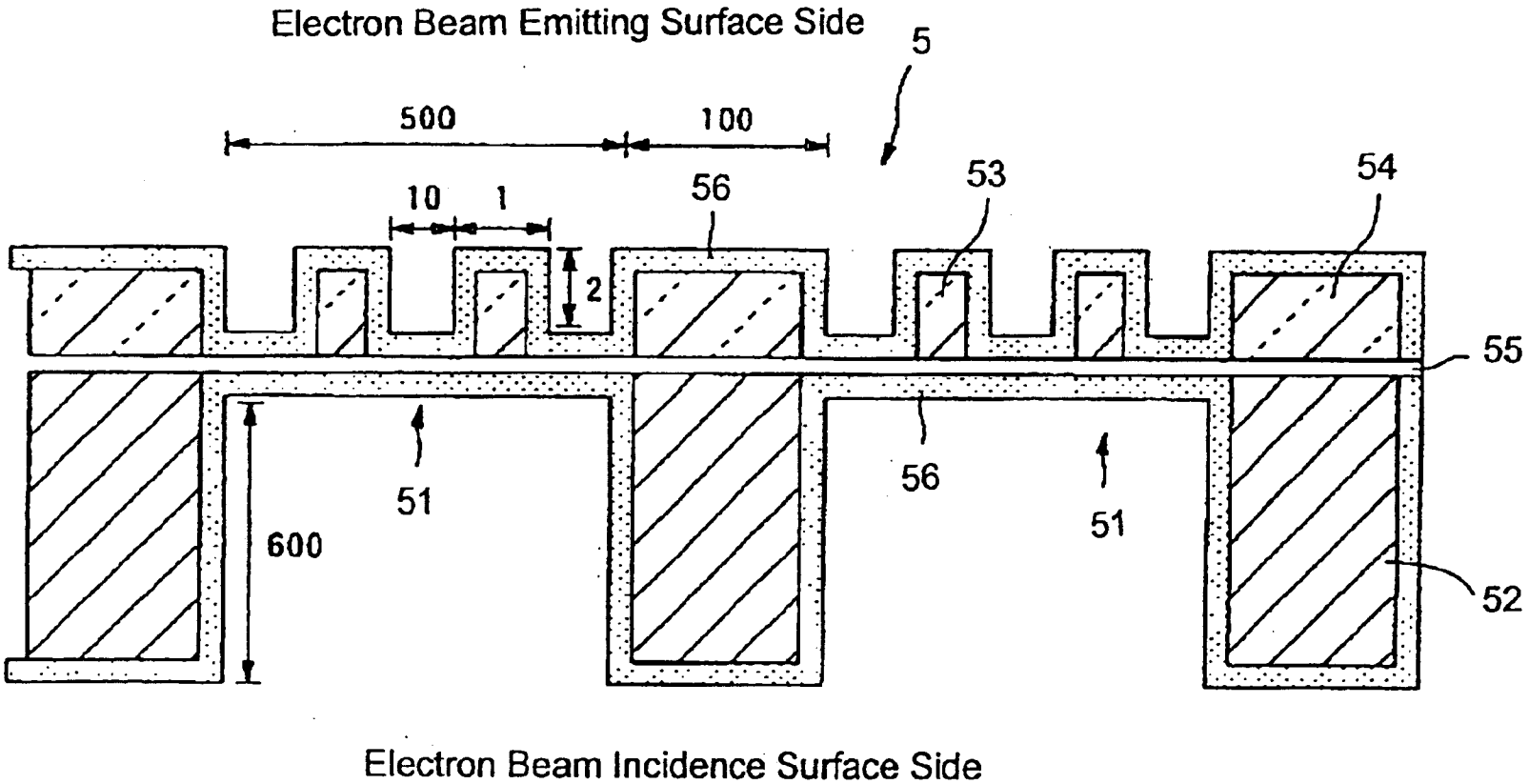
FIG. 8 is a cross sectional view of the window 5 which is made of material different from that of the window 5 shown in FIG. 6.

FIG. 8 is a cross sectional view of the window 5 which is made of material different from that of the window 5 shown in FIG. 6.

The window 5 shown in FIG. 8 is different from the window 5 shown in FIG. 6, in terms of material, that is, the second projections 53 and third projections 54 are made of polycrystalline Si (poly-Si) or amorphous Si in place of Si which is a single crystal. The thermal conductivity of the polycrystalline Si and amorphous Si is high as well as the single crystal Si, so that the heat generated in the window 51 is effectively transferred from the second projections 53 to the third projections 54 and first projections 52.

Next, an example of a manufacturing method of the window 5 shown in FIG. 8 is explained referring to FIG. 9.

Figure 9A:
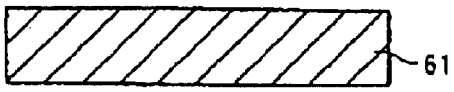
FIGS. 9A–9K are diagrams for showing steps of a manufacturing method of the window 5 shown in FIG. 8.

As shown in FIG. 9A, first, starting material 61 which is made of Si and ground on the both side is prepared.

Figure 9B:
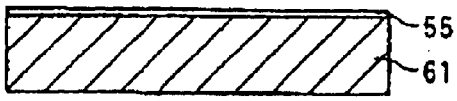

Next, as shown in FIG. 9B, an etching stop layer 55 made of $SiO_2$ is formed on the upper surface of the starting material 61 by thermal oxidation.

Figure 9C:
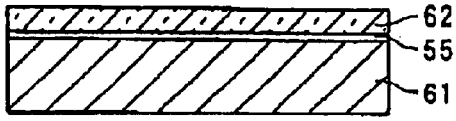

Next, as shown in FIG. 9C, the upper layer 62 made of polycrystalline Si is formed on the surface of the etching stop layer 55 by CVD.

Figure 9D:
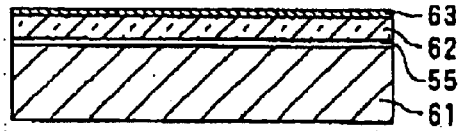
Figure 9E:
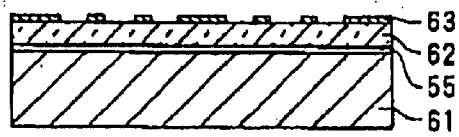
Figure 9F:
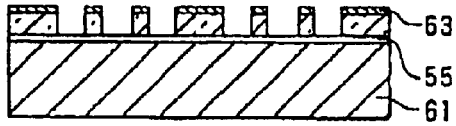
Figure 9G:
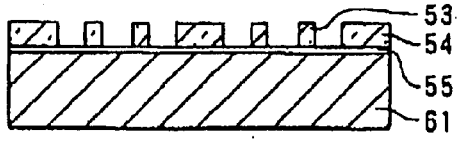

Next, a resist 63 is applied to the surface of the upper layer 62 as shown in FIG. 9D, and then the material on which the resist is applied is exposed and developed so as to form a predetermined pattern as shown in FIG. 9E and then dry etching is performed as shown in FIG. 9F, and the resist 63 is removed as shown in FIG. 9G whereby projections corresponding to the second projections 53 and the third projection 54 shown in FIG. 8 are formed on the upper portion of the etching stop layer 55.

Figure 9H:
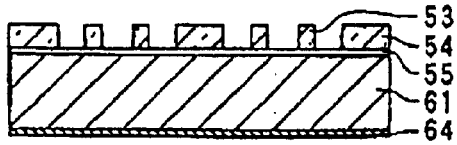
Figure 9I:
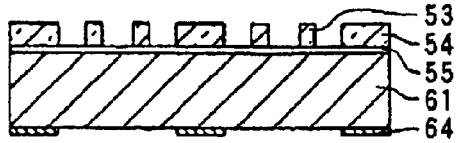
Figure 9J:
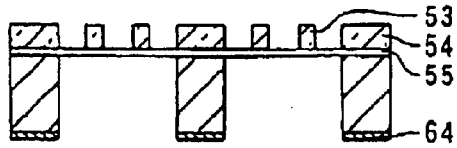
Figure 9K:
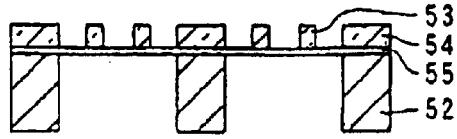

Next, as shown in FIG. 9H, a resist 64 is applied to the surface of the lower layer 61 of the starting material 61, and then the material on which the resist is applied is exposed and developed so as to form a predetermined pattern as shown in FIG. 9I, and then dry etching is performed as shown in FIG. 9J, and next the resist 64 is removed as shown in FIG. 9K whereby projections corresponding to the first projections 52 shown in FIG. 8 are formed on the lower portion of the etching stop layer 55.

At end of the process, although not illustrated, the protective film made of SiC or SiN is formed on the both sides of the window 5 thereby obtaining the window 5 as shown in FIG. 8.

Figure 10:
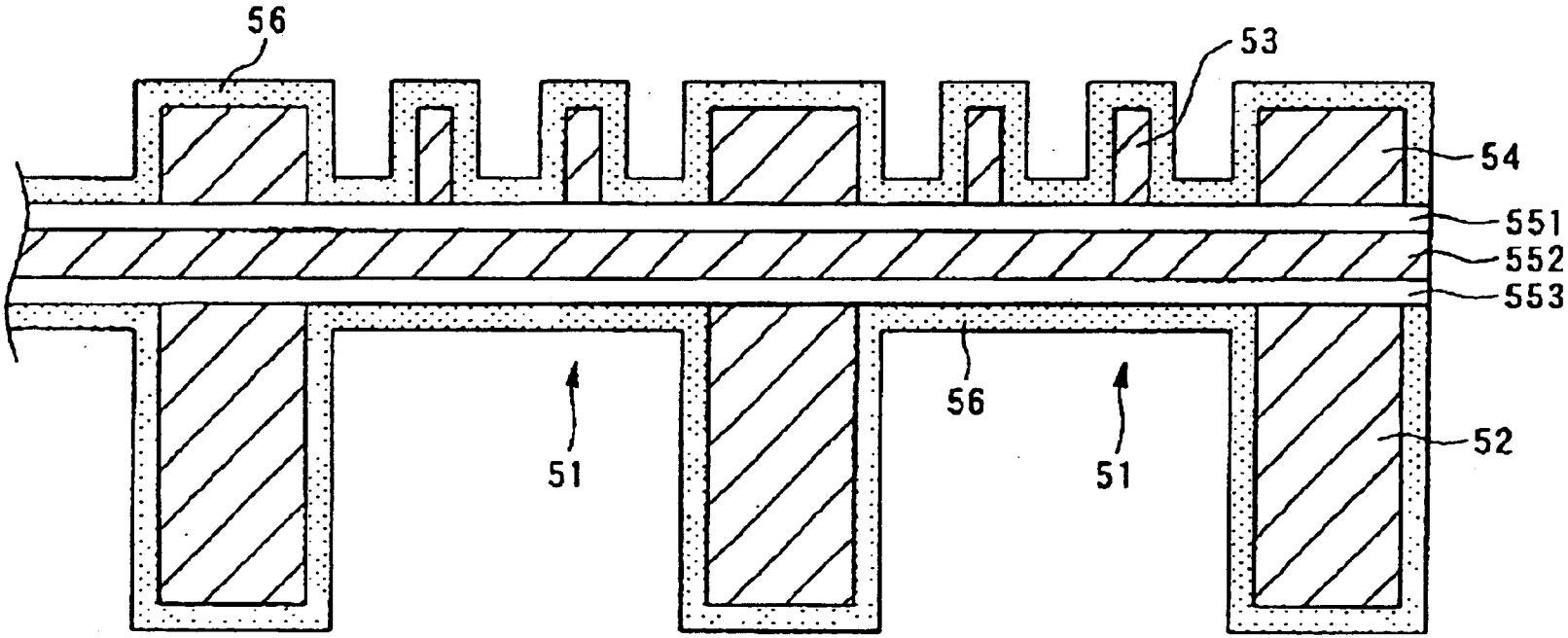
FIG. 10 is a cross sectional view of the window 5 which is made of material different from that of the window 5 shown in FIGS. 6 and 8.

FIG. 10 is a cross sectional view of the window 5 which is made of material different from that of the window 5 shown in FIGS. 6 and 8.

The window 5 shown in FIG. 10 is different from the window 5 shown in FIG. 8, in that etching stop layers 551 and 553 are formed on the upper layer and the lower layer of an intermediate layer 552 respectively.

By forming the intermediate layer 552 made of Si having high thermal conductivity between the etching stop layer 551 and 553, heat generated in the window portions 51 can be transferred to the third projection 54 and first projections 52 by the second projections 53. In addition, the heat can be directly transferred to the first projection 52 through the intermediate layer 552 made of Si so that temperature rise of the window portions 51 can be effectively controlled.

In this embodiment, although Si is used for the intermediate layer 552, $Al_2O_3$ having high thermal conductivity may be used for the intermediate layer 552 in place of Si.

In addition, Si may be used for the intermediate layer 552, and $Al_2O_3$ having high thermal conductivity may be used as the etching stop layers 551 and 553 in place of $SiO_2$.

Figure 11:
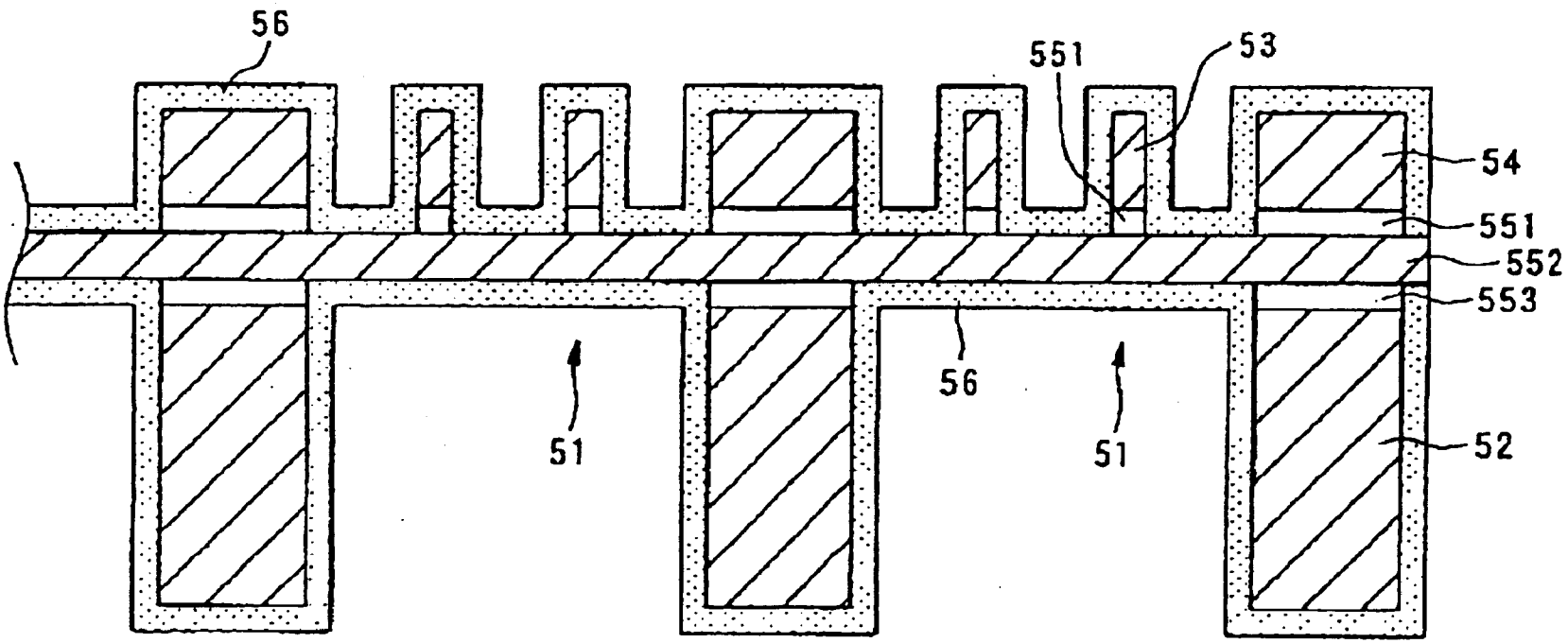
FIG. 11 shows another example of the window 5 shown in FIG. 10.

FIG. 11 shows another example of the window 5 shown in FIG. 10. The window 5 in FIG. 11 is different from that shown in FIG. 10 in that the $SiO_2$ etching stop layers 551 and 553 between the first projections 52, the second projections 53 and third projections 54 are removed. In such a structure, the thermal conductivity of Si which is 168 W/m·K is larger that that of $SiO_2$ which is 1.4 W/m·K, that is, the thermal conductivity of Si is larger than that of $SiO_2$ on the order of two digits.

For this reason, when an electron beam is emitted on the same condition, it is possible to reduce the temperature of the window compared with the case where the window 5 made of $SiO_2$ is used, thereby extending the life of the window 5 while an electron beam input can be further increased.

Figure 12:
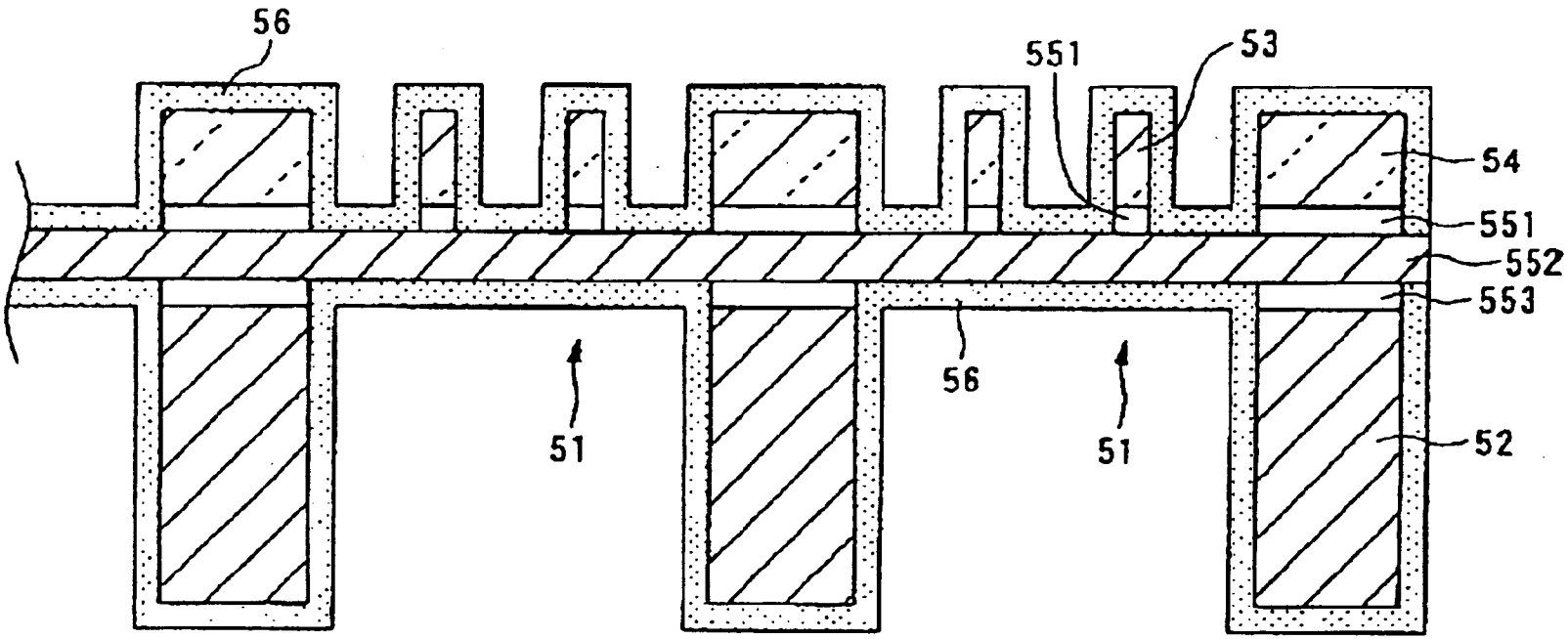
FIG. 12 is still another example of the window 5 shown in FIG. 10 in case that polycrystalline Si (poly-Si) or amorphous Si is used for the second projection 53 and the third projection 54.

FIG. 12 shows still another example of the window 5 shown in FIG. 10 wherein polycrystalline Si (poly-Si) or amorphous Si is used for the second projections 53 and the third projections 54. These windows can also have the same effects as the window shown in FIG. 11.

In addition, in the embodiments of the present invention shown in FIGS. 6, 8, 10–12, although the first projections 52 are formed on the electron beam incidence surface of the window 5, and the second projections 53 and the third projections 54 are formed on the electron beam emitting surface of the window 5, the present invention is not limited to such structures. The second projection 53 and the third projection 54 may be formed on one of the electron beam emitting surface and the electron beam incidence surface of the window 5 and the first projection 52 may be formed on the other surface of the window 5.

With such a structure, as described above, the window 5 is mechanically reinforced by the first projections 52 and heat generated when an electron beam passes through the spaced areas between the second projections 53 is transferred from the second projection 53 to the third projections 54. Since finally the heat can be transferred to the lid member 3 thereby releasing the heat, it is possible to control the temperature rise of the window portion 51 thereby preventing breakage of the window portion 51 due to the heat.

Next, description of the second embodiment of the present invention will be given below referring to FIGS. 13 to 15.

Figure 13:
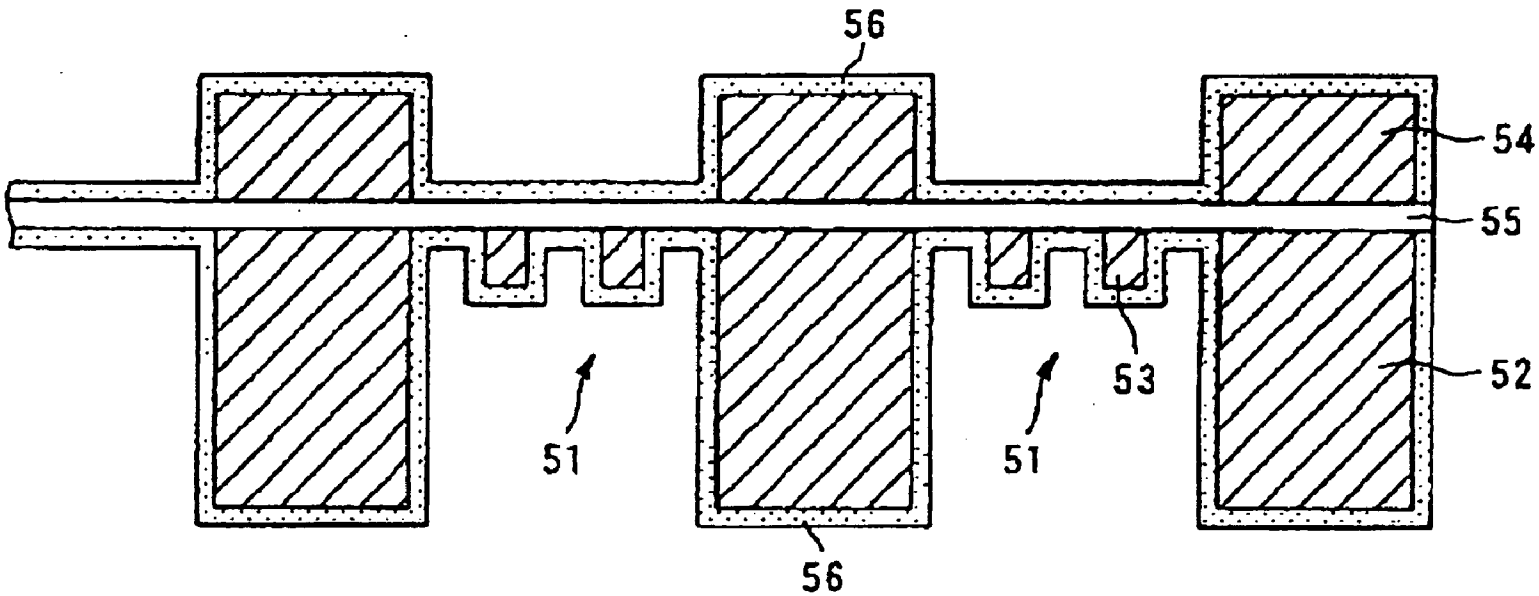
FIG. 13 is a cross sectional view of the window 5 of the electron beam tube according to an second embodiment of the present invention.

FIG. 13 is a cross sectional view of the window 5 of the electron beam tube according to the embodiment of the present invention. The window 5 in this embodiment is different from the window 5 according the first embodiment shown in FIG. 6, in that the second projections 53 are formed on the electron beam incidence surface which is the surface on which the first projections 52 are formed.

In the window 5 in this embodiment, heat generated in the spaced area between the second projections 53 when an electron beam passes through the spaced area is transferred to the second projection 53, and further, the heat transferred to the second projections 53 is transferred to the first projections 52, and finally, transferred to the lid member 3 and radiated.

Consequently, even if the high output electron beam passes through the window portion 51, and generation of heat in the window portion 51 increases, the generated heat can be effectively released to the lid member 3 through the second projections 53 so that the temperature rise of the window portion 51 can be controlled and breakage of the window portion 51 by heat can be prevented.

The window 5 in this embodiment, as well as the window 5 shown in FIG. 10, may be made up of an intermediate layer 552 made of Si and etching stop layers 551 and 553 made of $SiO_2$, and formed on the upper layer and lower layer of the intermediate layer 552, in place of the etching stop layer 55 shown in FIG. 13.

Next, an example of a manufacturing method of the window 5 shown in FIG. 13 is explained referring to FIGS. 14A–14L.

Figure 14A:
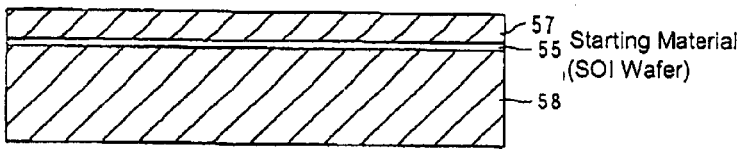
FIGS. 14A–14L are diagrams for showing steps of a manufacturing method of the window 5 shown in FIG. 13.
Figure 15:
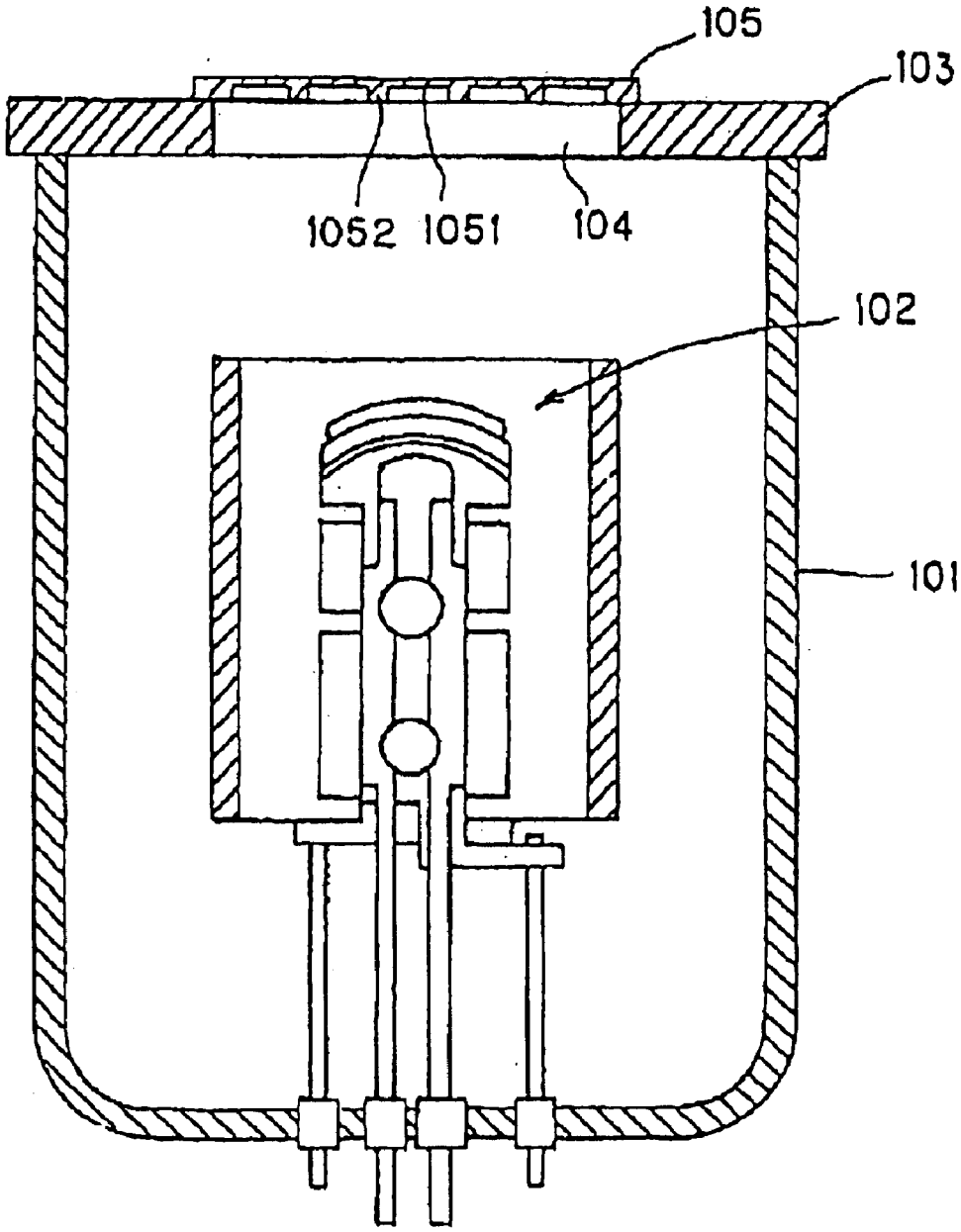
FIG. 15 PRIOR ART
FIG. 15 is a cross sectional view of the overall structure of a conventional beam tube.

As shown in FIG. 14A, first, starting material in which a lower layer 58 made of Si is formed on a lower side of the etching stop layer 55 made of $SiO_2$ and an upper layer 57 which is made of Si and thinner than the lower layer 58 is formed on an upper side of the etching stop layer 55 is prepared.

Figure 14B:
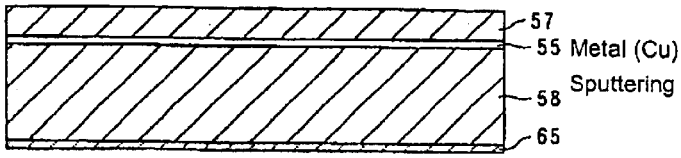

Next, as shown in FIG. 14B, a metal layer 65 made of Cu is formed on the surface of the lower layer 58 by sputtering.

Figure 14C:
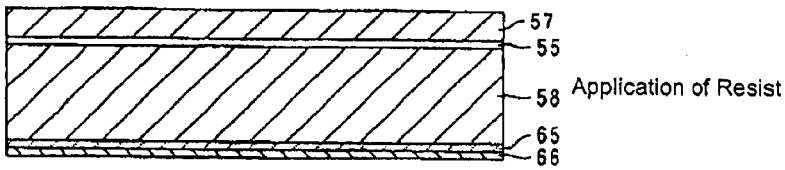
Figure 14D:
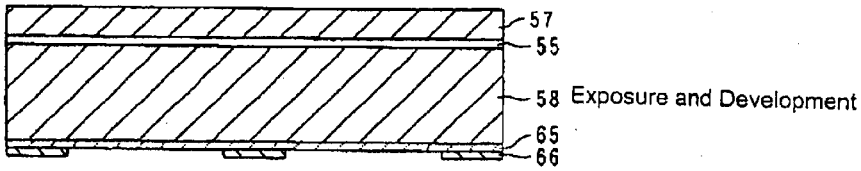
Figure 14E:
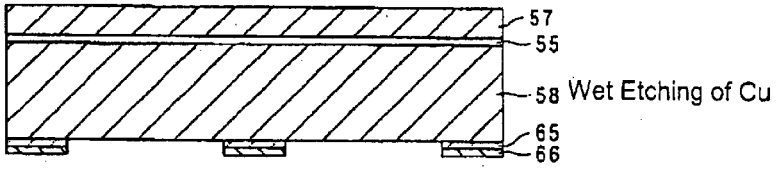

Next, a resist 66 is applied to the surface of the metal layer 65 as shown in FIG. 14C, and then the surface is exposed and developed so that a predetermined pattern may be formed as shown in FIG. 14D, and a metal layer 65 is removed by wet etching, as shown in FIG. 14E.

Figure 14F:
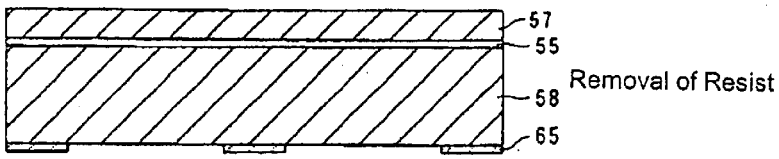
Figure 14G:
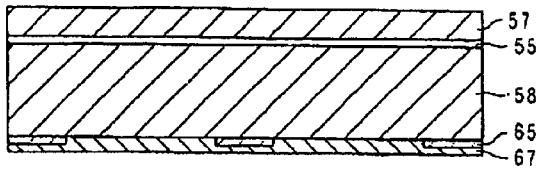

Next, as shown in FIG. 14F, after removing the resist 66, a resist 67 is applied to it again as shown in FIG. 14G.

Figure 14H:
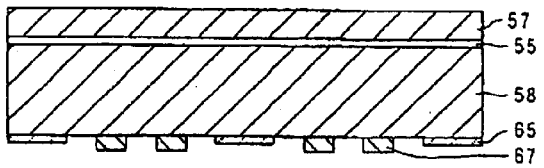
Figure 14I:
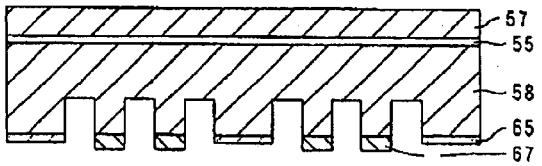

Next, as shown in FIG. 14H, the surface is exposed and developed so that a predetermined pattern may be formed, and dry etching of the lower layer 58 is performed to a predetermined depth as shown in FIG. 14I.

Figure 14J:
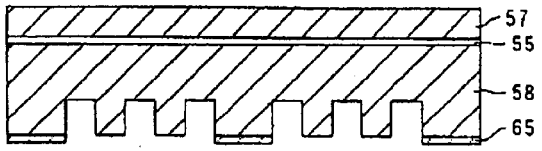
Figure 14K:
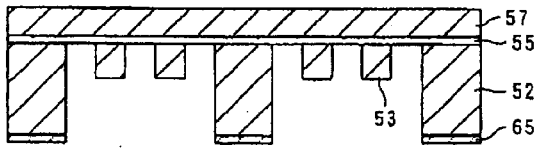

Next, as shown in FIG. 14J, a resist 67 is removed, and as shown in FIG. 14K, dry etching of the lower layer 58 is again performed to the etching stop layer 55.

Figure 14L:
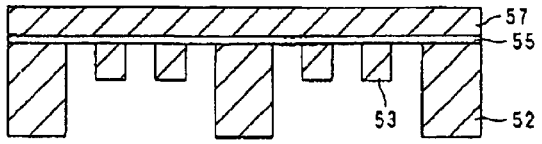

Then, as shown in FIG. 14L, the metal layer 65 is removed by wet etching.

According to the process described above, projections corresponding to the first projections 52 and the second projections 53 can be formed on the lower portion of the etching stop layer 55.

Next, by the same process as that shown in FIGS. 7B through 7E, projections corresponding to the third projections 54 are formed on the upper layer portion 57 of the etching stop layer 55.

Finally, after all the etching processings are completed, a protective film 56 made of SiC or SiN is formed on both sides of the window 5, thereby obtaining the window 5 shown in FIG. 13.

Although, in the manufacturing process of the window 5 shown in FIG. 13, the projections corresponding to the third projections 54 are formed on the upper portion 57 of an etching stop layer 55 by the steps shown in FIGS. 7B–7E after the process of FIG. 14L, no third projections may be formed on the upper layer 57 in this example.

Although, in the embodiment of the present invention, as shown in FIG. 13, the first projections 52 and the second projections 53 are formed on the electron beam incidence surface of the window 5, and the third projections 54 are formed on the electron beam emitting surface of the window 5, the present invention is not limited to such structures. The third projections 54 may be formed on one of the electron beam emitting surface and the electron beam incidence surface of the window 5, and the first projections 52 and the second projections 53 may be formed on the other surface of the window 5.

With such a structure, as described above, the window 5 is mechanically reinforced by the first projections 52 and heat generated when an electron beam passes through the spaced areas between the second projections 53 is transferred from the second projections 53 to the first projections 52. Since finally the heat can be transferred to the lid member 3 thereby releasing the heat, it is possible to control the temperature rise of the window portion 51 thereby preventing breakage of the window portion 51 due to the heat.

Figure 16:
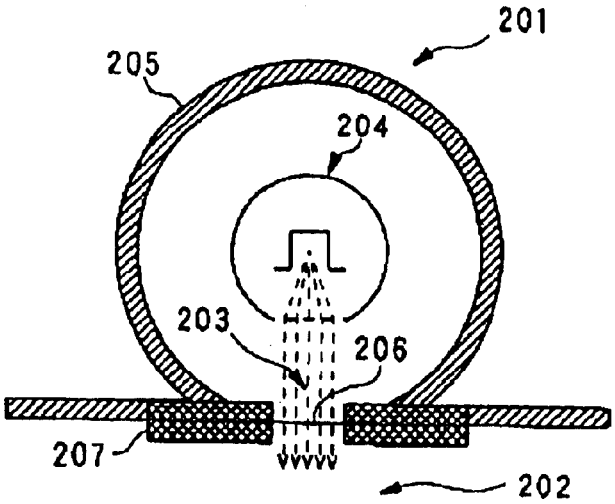
FIG. 16 is a cross sectional view of the overall structure of a conventional electron beam irradiation device.
Figure 17:
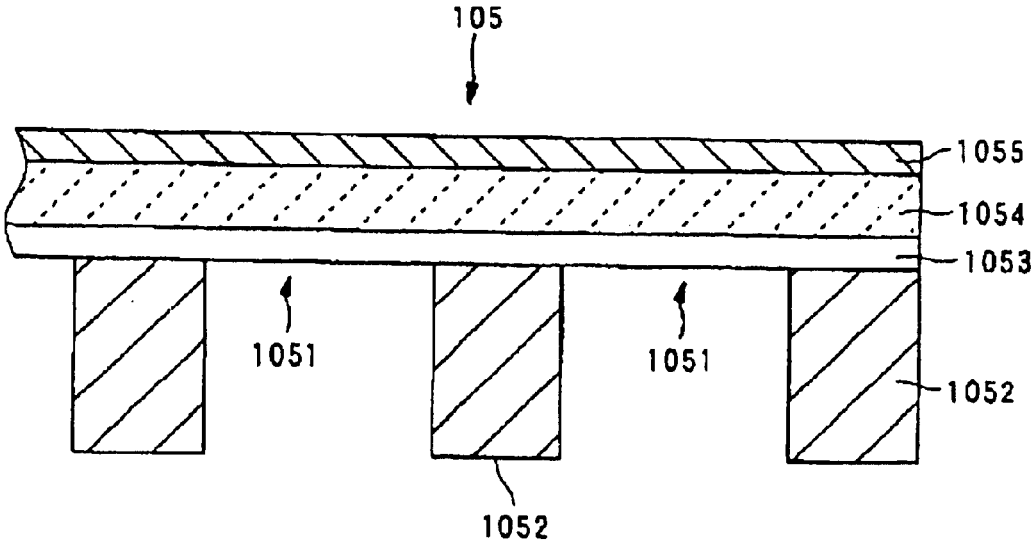
FIG. 17 is a cross sectional view of part of a window 105 used for an electron beam tube shown in FIG. 15, which is manufactured by the conventional manufacturing method.

In addition, although, in the above-mentioned embodiments, the window is applied to a thermionic-tube type electron beam tube as shown in FIG. 1, the application is not limited to such an electron beam tube, and for example, it is possible to apply it to a window for electron beam extraction in an electron beam irradiation device as shown in FIG. 16.

Thus, according to the present invention, since the electron beam tube in which the electron beam generator is disposed in the vacuum container having the window for emitting the electron beam comprises the first projections continuously provided on the first surface of the window, and the second projections which are continuously formed on the second surface of the window and are located in positions corresponding to areas between the first projections wherein the projection height of the second projection, the projection width of the second projection and the distance between the adjacent second projections are smaller than those of the first projections, respectively, the window is mechanically reinforced by the first projections and heat generated when an electron beam passes through the window can be transferred outside the window by the second projections so that the temperature rise of the window can be controlled and breakage of the window by heat can be prevented.

Since the electron beam tube in which an electron beam generator is disposed in a vacuum container having a window for emitting an electron beam, the electron beam tube comprises the first projections continuously provided on the first surface of the window, and the second projections which are continuously formed between the first projections on the first surface of the window wherein the projection height of the second projections, the projection width of the second projections and the distance between the adjacent second projections are smaller than those of the first projections respectively, the window is mechanically reinforced by the first projections and heat generated when an electron beam passes through the window can be transferred outside the window by the second projections so that the temperature rise of the window can be controlled and breakage of the window by heat can be prevented.

Since the second projections may be made of a crystalline Si or amorphous Si, heat generated when an electron beam passes through the window may be effectively transferred outside the window.

Since the window may have at least a layer made of Si or $Al_2O_3$, heat generated when an electron beam passes through the window may be effectively transferred via this layer.

The mechanical intensity of the window is increased since the protective film which is made of SiC or SiN is provided on both sides of the window, and the stress which is generated when the protective film is formed in the window can be canceled, whereby it is possible to prevent warpage, compared with the case where the protective film is formed on only one side.

Further according to the present invention, since the electron beam extraction window in which an electron beam generated by the electron beam generator provided in the vacuum container is extracted outside the vacuum container, the electron beam extraction window comprises the first projections continuously provided on a first surface of the electron beam extraction window, and the second projections which are continuously formed on the second surface of the electron beam extraction window and are located in positions corresponding to areas between the first projections wherein the projection height of the second projection, the projection width of the second projection and the distance between the adjacent second projections are smaller than those of the first projections, respectively, the electron beam extraction window is mechanically reinforced by the first projections and heat generated when an electron beam passes through the electron beam extraction window can be transferred outside the electron beam extraction window by the second projections, whereby the temperature rise of the window can be controlled and breakage of the window by heat can be prevented.

Furthermore, according to the present invention, since the electron beam extraction window in which an electron beam generated by the electron beam generator provided in the vacuum container is extracted outside the vacuum container, the electron beam extraction window comprises the first projections continuously provided on the first surface of the electron beam extraction window, and the second projections which are continuously formed between the first projections on the first surface of the electron beam extraction window wherein the projection height of the second projections, the projection width of the second projections and the distance between the adjacent second projections are smaller than those of the first projections respectively, the window is mechanically reinforced by the first projections and heat generated when an electron beam passes through the window can be transferred outside the window by the second projections, whereby the temperature rise of the window can be controlled and breakage of the window by heat can be prevented.

Thus the present invention possesses a number of advantages or purposes, and there is no requirement that every claim directed to that invention be limited to encompass all of them.

The disclosure of Japanese Patent Application No. 2003-168629 filed on Jun. 13, 2003 including specification, drawings and claims is incorporated herein by reference in its entirety.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

What is claimed is:

1. An electron beam tube in which an electron beam generator is disposed in a vacuum container having a window for emitting an electron beam, the electron beam tube comprising:

first projections continuously provided on a first surface of the window, and second projections which are continuously formed on a second surface of the window and are located in positions corresponding to areas between the first projections wherein a projection height of the second projection, a projection width of the second projection and a distance between the adjacent second projections are smaller than those of the first projections, respectively.

2. An electron beam tube in which an electron beam generator is disposed in a vacuum container having a window for emitting an electron beam, the electron beam tube comprising:

first projections continuously provided on a first surface of the window, and second projections which are continuously formed between the first projections on the first surface of the window wherein a projection height of the second projections, a projection width of the second projections and a distance between the adjacent second projections are smaller than those of the first projections, respectively.

3. The electron beam tube according to claim 1, wherein the second projections are made of crystalline or amorphous Si.

4. The electron beam tube according to claim 2, wherein the second projections are made of crystalline or amorphous Si.

5. The electron beam tube according to claim 1, the window has at least a layer made of Si or $Al_2O_3$.

6. The electron beam tube according to claim 2, the window has at least a layer made of Si or $Al_2O_3$.

7. The electron beam tube according to claim 1, wherein a protective film made of SiC or SiN is formed on both sides of the window.

8. The electron beam tube according to claim 2, wherein a protective film made of SiC or SiN is formed on both sides of the window.

9. An electron beam extraction window in which an electron beam generated by an electron beam generator provided in a vacuum container is extracted outside the vacuum container, the electron beam extraction window comprising:

first projections continuously provided on a first surface of the electron beam extraction window, and second projections which are continuously formed on a second surface of the electron beam extraction window and are located in positions corresponding to areas between the first projections wherein a projection height of the second projection, a projection width of the second projection and a distance between the adjacent second projections are smaller than those of the first projections, respectively.

10. An electron beam extraction window in which an electron beam generated by an electron beam generator provided in a vacuum container is extracted outside the vacuum container, the electron beam extraction window comprising:

first projections continuously provided on a first surface of the electron beam extraction window, and second projections which are continuously formed between the first projections on the first surface of the electron beam extraction window wherein a projection height of the second projections, a projection width of the second projections and a distance between the adjacent second projections are smaller than those of the first projections respectively.

11. The electron beam extraction window according to claim 9, wherein the second projections are made of crystalline or amorphous Si.

12. The electron beam extraction window according to claim 10, wherein the second projections are made of crystalline or amorphous Si.

13. The electron beam extraction window according to claim 9, the window has at least a layer made of Si or $Al_2O_3$.

14. The electron beam extraction window according to claim 10, the window has at least a layer made of Si or $Al_2O_3$.

15. The electron beam extraction window according to claim 9, wherein a protective film made of SiC or SiN is formed on both sides of the window.

16. The electron beam extraction window according to claim 10, wherein a protective film made of SiC or SiN is formed on both sides of the window.

* * * * *